United States Patent [19]

Fann et al.

[11] Patent Number: 4,768,817

[45] Date of Patent: Sep. 6, 1988

[54] DEAD BOLT ASSEMBLY

[75] Inventors: Yaw-Shin Fann, Chiayi; Rong-Faa Wu, Chiayi Hsien, both of Taiwan

[73] Assignee: Tong Lung Metal Industry Co. Ltd., Chiayi, Taiwan

[21] Appl. No.: 74,269

[22] Filed: Jul. 16, 1987

Related U.S. Application Data

[63] Continuation-in-part of Ser. No. 840,597, Jan. 27, 1987, Pat. No. 4,639,025.

[51] Int. Cl.[4] ..... E05C 21/02

[52] U.S. Cl. ..... 292/337; 292/1; 292/173; 292/DIG. 60

[58] Field of Search ..... 292/337, 1, 173, DIG. 60, 292/DIG. 44

[56] References Cited

U.S. PATENT DOCUMENTS

| | | | |
|---|---|---|---|
| 4,593,542 | 6/1986 | Rotondi et al. | 292/337 X |
| 4,602,490 | 7/1986 | Glass et al. | 292/337 X |
| 4,639,025 | 1/1987 | Fann et al. | 292/337 |

*Primary Examiner*—Richard E. Moore

*Attorney, Agent, or Firm*—Ladas & Parry

[57] ABSTRACT

The invention relates to improvements for an adjustable dead bolt assembly which includes an adjustable bolt extension member connected to a bolt and an extension housing connected to a bolt casing for accommodating the bolt extension member, wherein the bolt is provided with a uniform height and width throughout the length of the bolt for reducing the cost of the material and simplifying the processing steps.

2 Claims, 1 Drawing Sheet

DEAD BOLT ASSEMBLY

This application is a continuation-in-part application of U.S. patent application Ser. No. 840,597 filed on Mar. 17, 1986 which is granted to a patent, U.S. Pat. No. 4,639,025, issued Jan. 27, 1987.

BACKGROUND OF THE INVENTION

The invention relates to an adjustable dead bolt assembly to be used in connection with a cylinder lock and can be adjusted to suit two door specifications.

The parent application discloses an adjustable dead bolt assembly which includes a bolt casing in which is mounted slideably a bolt, and an extension housing in which is mounted slideably a telescopic bolt extension member which is connected to the rear end of the bolt. The bolt extension member can be adjusted between a retracted position and a stretched position so that the entire length of the bolt can be shorter or longer as desired. In this dead bolt assembly, in order to prevent the bolt from releasing out of the bolt casing, the rear portion of the bolt is provided with raised surfaces on the periphery of the bolt, i.e. the cross-section of the rear portion is arranged to be larger than that of the front portion of the bolt, so that, when the bolt moves forward, the rear portion is stopped by a front plate which is screwed to the front end of the bolt casing. To fabricate such a bolt, it is required to use a stock of larger cross-section from which a large portion must be removed by machining. This increases the cost of the material as well as the processing steps of the bolt.

SUMMARY OF THE INVENTION

An object of the invention is to provide an adjustable dead bolt assembly with improvements by which the bolt can be procesed easily and the cost of material can be reduced.

The present invention provides an improvement for an adjustable dead bolt assembly which is disclosed in the parent application of this application. The adjustable dead bolt assembly comprises a bolt mounted in a bolt casing, and a bolt extension member which can be adjusted to have a shorter length or a longer length and which is connected to the bolt and mounted in an extension housing. The bolt extension member includes a fixed member connected to a rear forked end of the bolt and an extensible member pivoted to the fixed member. According to this invention, the bolt is arranged to be of uniform height and width throughout the length thereof; that is to say, no raised surface is provided on the outer periphery of the bolt. Such a construction is more easy to process and can be fabricated from a stock with a size smaller than the bolt disclosed in the parent application. Instead of the raised surfaces of the bolt previously disclosed, in this invention, the front end of the fixed member which is connected to the forked end of the bolt is provided with an upwardly extending flange and a downwardly extending flange to engage with a front mounting plate secured to the bolt casing.

The present exemplary preferred embodiment will be described in detail with reference to the accompanying drawings, in which:

DETAILED DESCRIPTION OF THE PREFERRED EMBODIMENT

Figure 1:
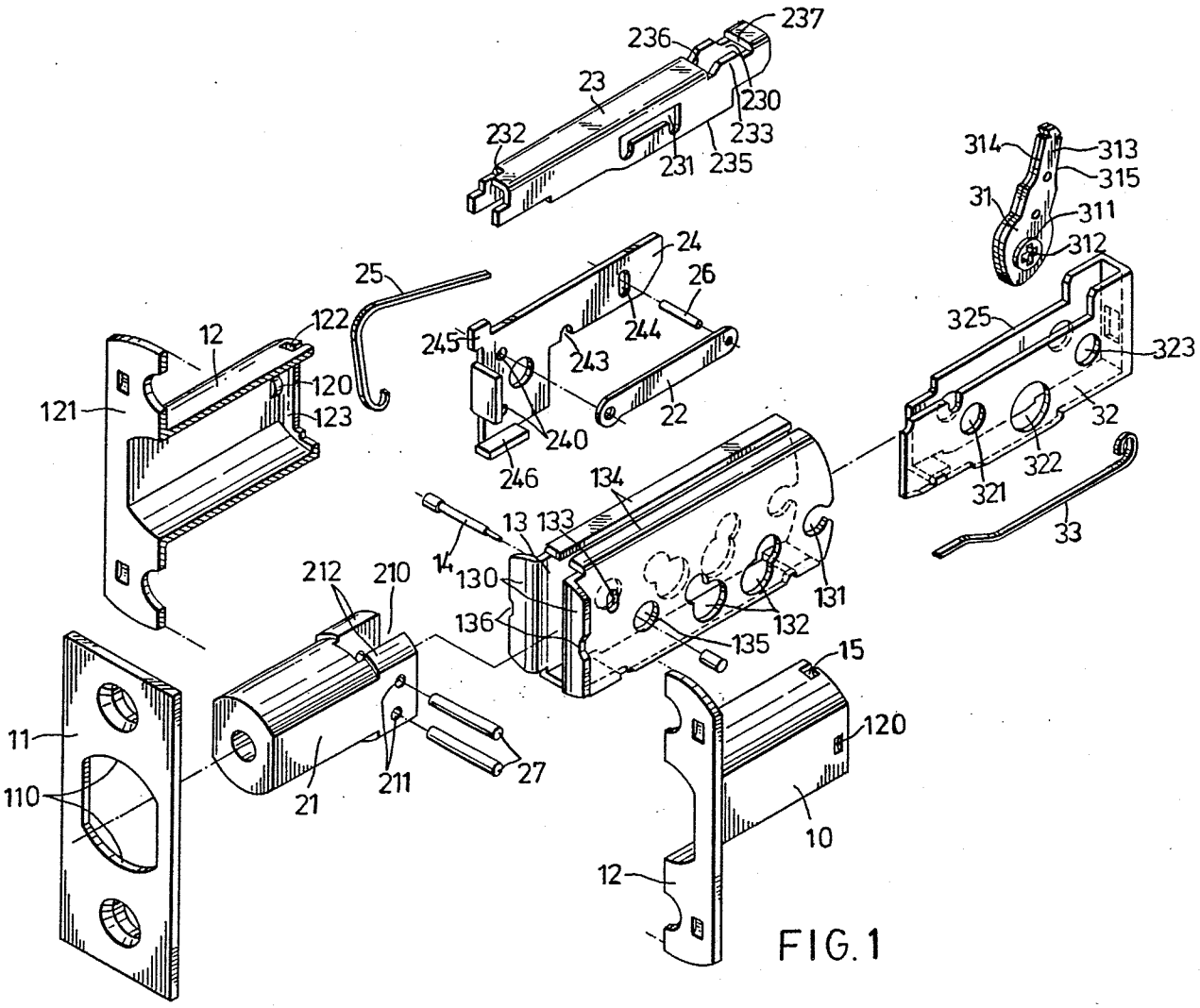
FIG. 1 shows an exploded view of a dead bolt assembly embodying the present invention.

Referring to the drawings, a dead bolt assembly is shown, having a bolt casing 12 having a front open end with a flange 121 which is screwed to a front mounting plate 11. A bolt 21 is mounted movably in the bolt casing 10 and has a rear forked end defining two flanks 212 which confine a space 210.

An extension housing 13 is connected to the rear open end of the bolt casing 12. The extension housing 13 is substantially a channel-shaped member and has two parallel panels which have front flanges 130 inserted into the casing 12 through notches 122 and abutting with the rear flanges 123 of the casing 12. The casing 12 further has two opposing bosses 120 to engage with notches 136 of the rear flanges 130. Each of the parallel panels of the extension housing 13 is provided with screw holes 131 and 135 and two apertures 132 of figure-8 shape. A pin 14 is inserted in oblong holes 133 of the panels. At the top sides of the panels are inwardly projecting top flanges 134.

A crank plate holding means 32 is mounted movably in the extension housing 13, and includes two parallel panels disposed movably between the parallel panels of the extension housing 13. In the panels of the crank plate holding means 32 are holes 321, 322 and 323.

The crank plate holding means 32 can be secured to the extension housing 13 in a first position in which holes 321, 322 and 323 are aligned respectively with screw holes 135, the lower side of the front apertures 132 and the upper side of the rear aperture 132, or in a second position in which the above holes are aligned respectively with the upper side of the front aperture 132, the lower side of the rear aperture 132 and the holes 131.

A crank plate 31 is mounted in the crank holding means 32 and adapted to be connected to a lock for transmitting the actuation of the lock to the bolt. The crank plate 31 is provided with bosses 311 which project into the holes 322 of the panels of the means 32. A cross-shaped hole 312 is provided in the crank plate 31 to engage with an actuating part of the lock (not shown). An upper arm 313 of the crank plate 31 extends into a hole 230 of the extensible member 23 and can be turned so as to move the extensible member 23 as well as the bolt 21 to move between a locking position and an unlocking position. A spring 33 is attached to the bottom side of the crank holding means 32 so as to retain the crank plate holding means in the extension housing. The bottom side of the crank plate 31 abuts with the spring 33 so that a resilient force is created to guide the movement of the crank plate 31.

To the forked end of the bolt 21 is connected an adjustable bolt extension member which is constituted of a fixed member 24 which has its front end disposed in and fixed to the rear forked end of the bolt 21, and an extensible member 23 rides on and connected movably to the fixed member 24. The fixed member 24 is received in the space 210 and connected to the bolt 21 by means of two pins 27. A guide plate 22 is attached to the fixed member 24 through the upper pin 27 and a pin 26 which is threaded through an oblong hole 244. A bent spring 25 is fixed to the lower pin 27 and is passed over the upper edge of the guide plate 22 to bias the guide plate downward.

The extensible member 23 has a longitudinal guide aperture 231 with a front engaging portion and a rear engaging portion which are turned at an angle relative to the longitudinal aperture. The pivot pin 26 of the guide plate 22 and the fixed member 24 also passes through the guide aperture 231 of the extensible member, thereby connecting the extensible member 23 to the fixed member 24. The extensible member 23 can be moved between a first position in which the pin 26 engages in the rear engaging portion of the aperture 231 and a second position in which the pin engages in the front engaging portion of the guide aperture 231.

The above-mentioned parts of the dead bolt assembly is disclosed previously in detail in the parent application. A feature of this invention resides in the construction of the bolt 21. Unlike the bolt of the parent application, the bolt 21 is of uniform height and uniform width throughout the length thereof; that is to say, no top raised surface and bottom raised surface is provided at the forked end of the bolt 21 for engaging with the edges 110 of the front plate 11. This not only facilitates the processing of the bolt but also reduces the dimension of the stock to be used. Instead of the raised surfaces of the bolt of the previous invention, in this invention, the fixed member 24 is additionally provided with a top flange 245 projecting upward to an extent higher than the top surface of the forked end of the bolt 21 and a bottom flange 246 projecting downward to an extent lower than the bottom surface of the forked end of the bolt 21. The top flange 245 and the bottom flange 246 will engage with the front plate 11 when the bolt 21 moves forward. The top side of the extensible member 23 is provided with a notch 232 for permitting the flange 245 to project outward.

As described hereinabove, the actuating arm 313 of the crank plate 31 projects out through the hole 230 of the extensible member 23. According to this invention, the actuating crank arm 313 is provided with smooth surfaces 314 and 315 instead of the protruded surfaces of the crank arm described in the parent invention, so as to contact smoothly with edges 236 and 237 of the extensible member 23, thereby enabling the crank arm 313 to drive smoothly the extensible member 23 when the crank plate is operated by a lock. Moreover, raised edges 233 are provided adjacent the crank arm receiving hole 230 of the extensible member 23 to guide the crank arm 313 so as to prevent it from moving in a transverse direction. In addition, unlike the stepped intermediate portion of the upper edge of the crank plate holding means of the assembly of the parent application, the intermediate portion 325 of the upper edge of the crank plate holding means 32 is arranged to be straight for permitting the lower edge 235 of the extensible member 23 to slide smoothly thereon.

With the invention thus explained, it is apparent that various modifications and variations can be made without departing from the scope of the invention. It is therefore intended that the invention be limited only as indicated in the appended claims.

What I claim is:

1. A dead bolt assembly for a lock comprising:

a bolt casing having a front open end and a rear open end;

a bolt mounted movably in said bolt casing and including a top surface, a bottom surface, two side surfaces interconnecting said top and bottom surfaces, and a rear forked end adjacent to said rear open end, said forked end having two spaced apart flank members;

an extension housing connected to said rear open end of said bolt casing;

an adjustable bolt extension member connected to said rear end of said bolt, the bolt extension member including a fixed member which has a front end disposed between said flank members and fixed thereto, and an extensible member connected movably to said fixed member, one of said fixed member and said extensible member having a longitudinal guide aperture with a front and a rear engaging portion which is turned at an angle relative to said longitudinal aperture, and a pivot pin for pivoting said fixed member and said extensible member, passing through said longitudinal guide aperture, said extensible member being movable between a first position in which said pivot pin engages in said rear engaging portion and a second position in which said pivot pin engages in said front engaging portion;

a crank plate mounted in said extension housing to be connected to the lock for transmitting the actuation of the lock to the bolt, said crank plate being turnable about an axis to move said bolt between a locking position and a releasing position;

a crank plate holding means which is disposed in said extension housing and which can be positioned adjustably in said extension housing in a first position and a second position corresponding to said first position and said second position of said extensible member so that said crank plate can be kept in a cooperative relationship with said extensible member; and the improvements wherein said bolt has a uniform height and width throughout the length of said bolt, and said front end of said fixed member has a first flange projecting upward to an extent higher than said top surface of said bolt and a second flange projecting downward to an extent lower than said bottom surface of said bolt.

2. A dead bolt assembly as claimed in claim 1, in which said bolt casing includes a top wall which has a rear edge with two first notches, a bottom wall, and two side walls interconnecting said top and bottom walls, each of said side walls having a rear end with an inwardly projecting third flange and a boss which is anterior to said third flange and projects inwardly from said side wall, wherein said extension housing has two parallel side panels each of which has a front end with an outwardly projecting fourth flange which has a second notch, said fourth flanges being inserted into said bolt casing through said first notches of said top wall respectively, each of said fourth flanges abutting with one of said third flanges and having a top side engaging in one of said first notches, said bosses engaging respectively with said second notches.

* * * * *